US008079192B2

(12) United States Patent
Gerkes et al.

(10) Patent No.: US 8,079,192 B2
(45) Date of Patent: Dec. 20, 2011

(54) SUSPENDED CEILING GRID SYSTEM

(75) Inventors: Martin Daniel Gerkes, Toronto (CA); Heikki Kolga, Maple (CA); Ronald White, Holland Landing (CA)

(73) Assignee: Decoustics Limited, Woodbridge, ON (CA)

( * ) Notice: Subject to any disclaimer, the term of this patent is extended or adjusted under 35 U.S.C. 154(b) by 0 days.

(21) Appl. No.: 12/659,497

(22) Filed: Mar. 11, 2010

(65) Prior Publication Data

US 2011/0219718 A1 Sep. 15, 2011

(51) Int. Cl.
*E04B 2/00* (2006.01)

(52) U.S. Cl. ..... 52/506.08; 52/506.06; 52/506.07; 52/506.1; 52/656.9; 52/655.1

(58) Field of Classification Search ..... 52/506.06, 52/506.07, 506.08, 506.1, 656.9, 655.1
See application file for complete search history.

(56) References Cited

U.S. PATENT DOCUMENTS

| | | | | | |
|---|---|---|---|---|---|
| 22,273 | A * | 12/1858 | Atwood | 112/311 |
| D22,273 | S * | 3/1893 | Grafton et al. | D25/143 |
| 4,019,300 | A * | 4/1977 | Sauer et al. | 52/665 |
| 4,438,613 | A * | 3/1984 | Hintsa et al. | 52/506.09 |
| 4,548,010 | A * | 10/1985 | Hintsa | 52/506.09 |
| 5,241,799 | A * | 9/1993 | Jahn | 52/506.06 |
| 5,428,930 | A * | 7/1995 | Bagley et al. | 52/506.07 |
| 5,535,566 | A * | 7/1996 | Wilson et al. | 52/506.07 |
| 6,029,413 | A * | 2/2000 | Compas, Jr. | 52/506.06 |
| 6,536,167 | B2 * | 3/2003 | Glavan | 52/81.3 |
| 6,971,210 | B2 * | 12/2005 | Kliegle et al. | 52/506.07 |
| 7,478,506 | B2 * | 1/2009 | Wendt et al. | 52/506.07 |
| 7,673,429 | B2 * | 3/2010 | Frecska | 52/506.07 |
| 7,770,338 | B2 * | 8/2010 | Nefzi | 52/81.2 |
| 7,770,349 | B2 * | 8/2010 | Tedesco et al. | 52/506.08 |
| 2003/0230043 | A1 * | 12/2003 | Likozar et al. | 52/506.07 |
| 2004/0118068 | A1 * | 6/2004 | Kliegle et al. | 52/483.1 |
| 2005/0034402 | A1 * | 2/2005 | Johnson | 52/506.08 |
| 2006/0162283 | A1 * | 7/2006 | Moser Rossel | 52/798.1 |
| 2006/0218871 | A1 * | 10/2006 | Wendt et al. | 52/506.07 |
| 2010/0005747 | A1 * | 1/2010 | Tedesco et al. | 52/506.08 |

* cited by examiner

*Primary Examiner* — Brian Glessner
*Assistant Examiner* — Gisele Ford

(57) ABSTRACT

A suspended ceiling system uses a grid system having series of intermediate nodes interior to a peripheral edge of the ceiling system and a series of edge nodes at an edge of the grid system. Each intermediate node is defined by a connection plate having a series of guide tracks for receiving and cooperating with an upper edge of the ceiling grid members to align the grid members in a predetermined geometric configuration. Mechanical fasteners secure the connection plate and the ceiling grid members in any of the guide tracks. Each connection plate between adjacent guide tracks includes generally opposed connection slots for receiving support springs suspending ceiling panels beneath the grid system. The connection plate simplifies installation and avoids incorrect placement of the grid members. Preferably the grid system includes at least five grid members equally spaced about a center point of the connection plate. In a further preferred structure at least six grid members are secured to a connection plate and the ceiling panels are of a triangular shape.

14 Claims, 11 Drawing Sheets

Detail A

SUSPENDED CEILING GRID SYSTEM

FIELD OF THE INVENTION

The present application is directed to suspended ceiling systems, and in particular to a grid network used to suspend ceiling panels.

BACKGROUND OF THE INVENTION

Examples of suspended ceiling systems are shown in the applicant's earlier U.S. Pat. Nos. 4,436,613 and 5,428,930. The first patent shows a suspended grid system having a series of extruded components that connect to form junction members. These junction members include vertical slots and each individual grid member is received in a slot and secured to the junction member. The individual junction members are suspended from appropriate structural members. Each grid member slidably receives a ceiling panel support bracket along a top edge thereof. These support brackets include slots for receiving extended legs of torsion springs used to suspend the ceiling panel beneath the grid system. The system works satisfactorily but requires specialized components, substantial installation time and expertise in assembly.

U.S. Pat. No. 5,428,930 discloses a system for use in association with a modified 'T' bar suspended ceiling systems providing effective alignment of panels suspended beneath the 'T' bar system. This arrangement is a cost effective solution suitable for rectilinear grid systems and is less suitable for complex installations.

The present invention provides an effective system that has good structural integrity, accommodates complex ceiling systems and has advantages with respect to installation.

SUMMARY OF THE INVENTION

A suspended ceiling system according to the present invention comprises a grid system having series of intermediate nodes interior to a peripheral edge of the ceiling system and a series of edge nodes at said peripheral edge of the grid system. The series of intermediate nodes each include a connection plate having a series of guide tracks for receiving and cooperating with an upper edge of the ceiling grid members to align the grid members in at least one predetermined geometric configuration. Each connection plate includes mechanical fasteners securing the connection plate and the ceiling grid members in any of the guide tracks. Each connection plate between adjacent guide tracks includes generally opposed connection slots for receiving support springs suspending ceiling panels beneath the grid system.

According to an aspect of the invention, at least one predetermined geometric configuration includes at least five grid members equally spaced about a center point of the connection plate.

According to a further aspect of the invention, the predetermined geometric configuration includes at least six grid members and the ceiling panels are of a triangular shape.

In yet a further aspect of the invention each connecting plate includes six projecting arms with each arm including a guide track. Four of the guide tracks include a stop member spaced from a center point of a connection plate a sufficient distance to accommodate a grid member extending completely across the connection plate between two aligned projecting arms.

In yet a further aspect of the invention the connection plate between adjacent projecting arms includes a notched-out recess with the sides of the projecting arms in the notched-out recesses defining the generally opposed connection slots for receiving supporting springs of adjacent ceiling panels.

In yet a further aspect of the invention the suspended ceiling system includes equilateral triangular ceiling panels suspended below the grid system.

In yet a further aspect of the invention the connection plates are shaped to define a non-rectilinear grid when the grid members are connected thereto. The shaped connection plates being configured for a series of main grid members extending continuously between at least three intermediate nodes.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
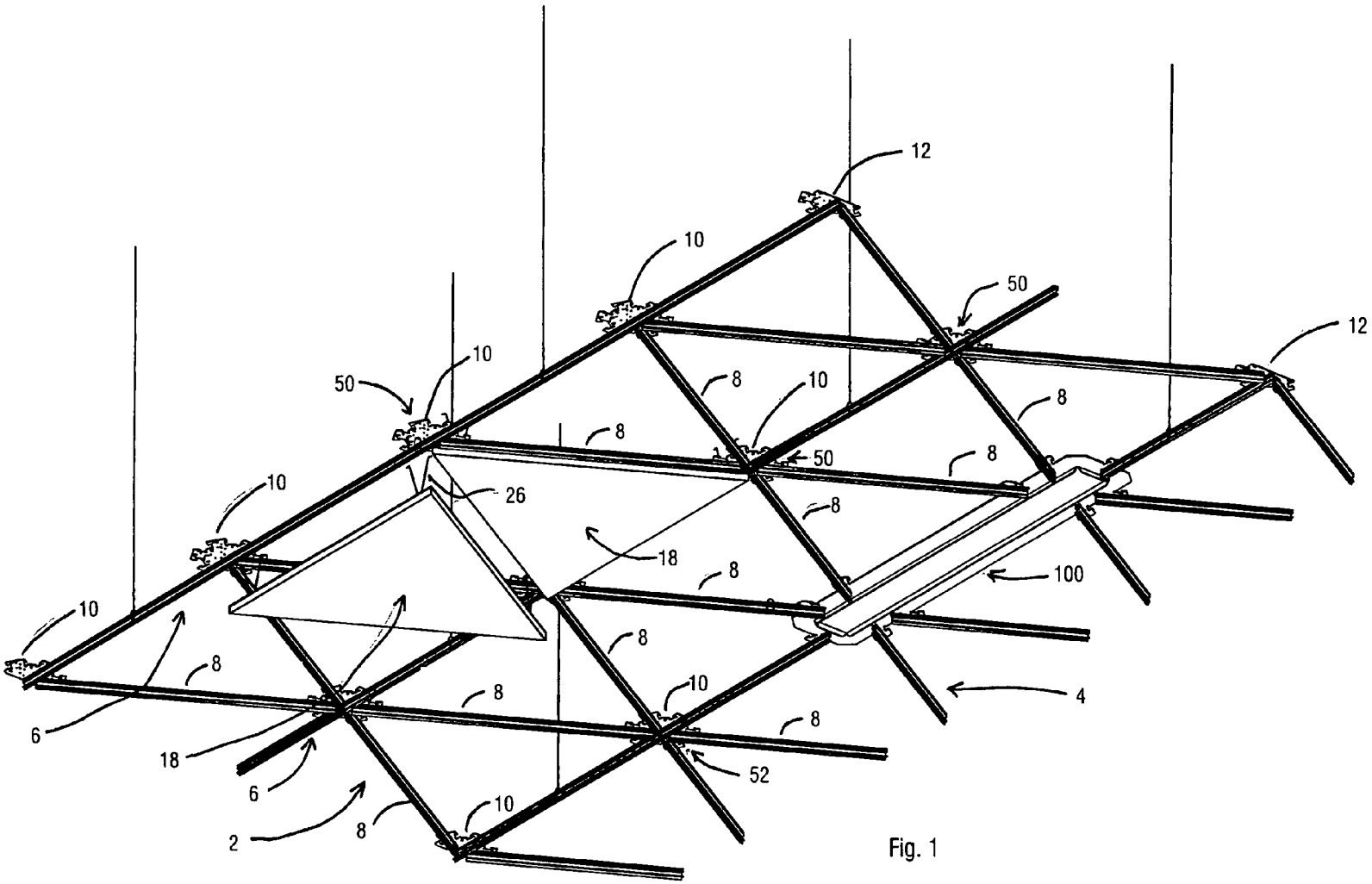
FIG. 1 is a bottom partial perspective view of a suspended ceiling system and grid network with two triangular ceiling panels.

The suspended ceiling system 2 includes a grid system 4 having ceiling panels 18 suspended there below. The grid system 4 is preferably defined by main grid members 6 which extend through aligned intermediate nodes 10 typically in a length of the ceiling system. Secondary grid members 8 connect adjacent nodes. These secondary grid members 8 are of a short length and do not extend through the center of the intermediate nodes 10. A series of edge nodes 12 are provided at the peripheral edge of the ceiling panel system and as shown these are typically half nodes.

Figure 7:
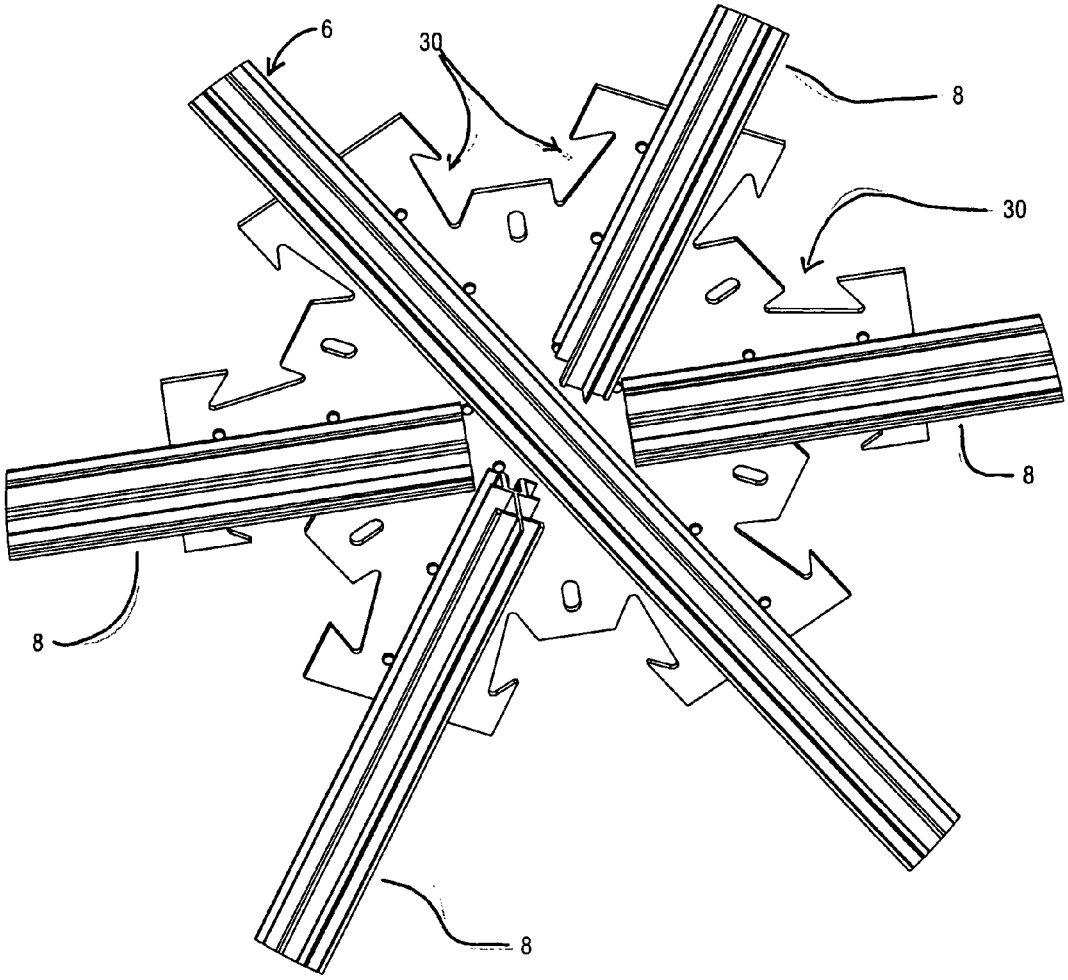
FIG. 7 is a bottom view of the intermediate node of FIG. 5.

The suspended ceiling panels 18 are essentially aligned beneath the grid members and preferably the grid members include a downwardly extending flange 76 (see FIGS. 5 and 7) which provides an alignment surface for engaging the edges of the panels, the ceiling panels cover and conceal the grid system. It is preferred that the grid system define individual cells for each panel. Torsion springs 26 are provided near the corners of the ceiling panels for suspending of the panels beneath the grid system 4. Each of the nodes (i.e. the intermediate nodes 10 and the edge nodes 12) include torsion spring securing slots 30. These securing slots are provided near an outer edge portion of the intermediate and peripheral nodes and preferably are located in project arm 52 of the nodes.

Figure 3:
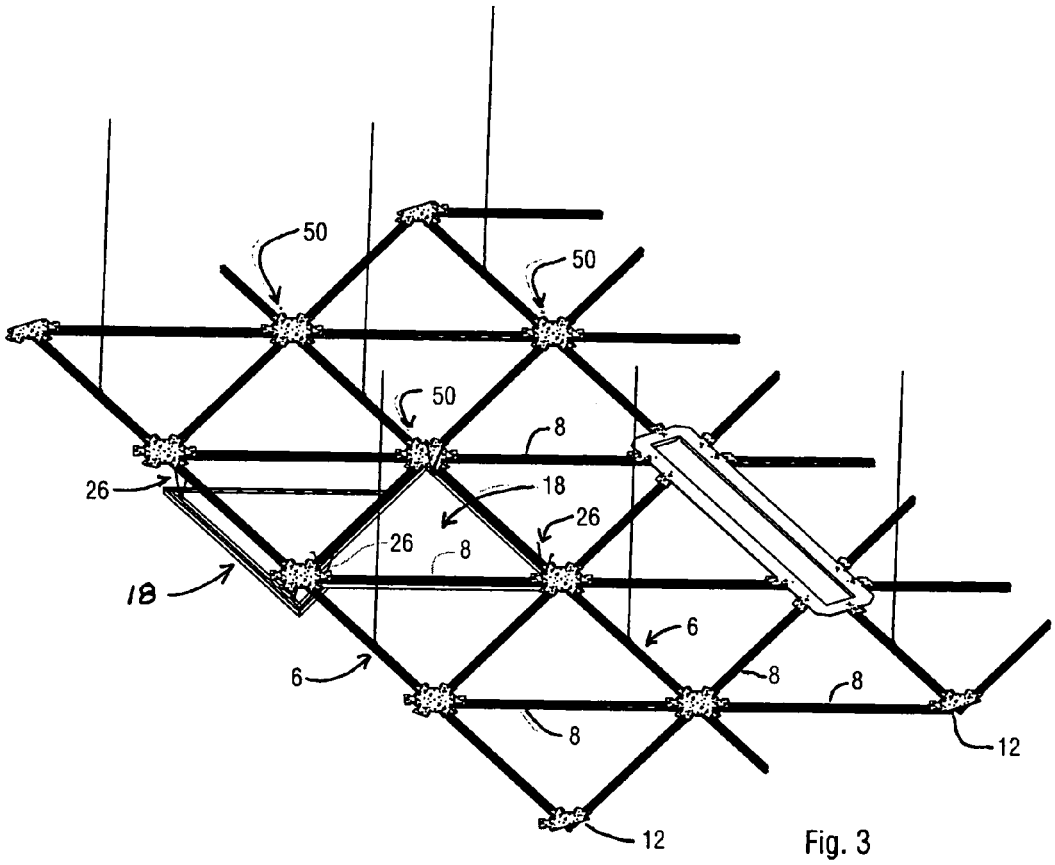
FIG. 3 is a top partial perspective view of the ceiling grid network of FIG. 1.

FIGS. 1 and 3 show a series of intermediate nodes 10 and the use of the connection plates 50 for securing of the grid members 6 and 8 in a desired configuration of the grid system. These connection plates include guide tracks 56 and dimple stops 58 to accurately position the various grid members and thereby accurately define the geometry and size of the cells. This assists in the assembly of the grid network and in the preferred embodiment of the invention, the grid system 4 is assembled at desk or table height. Once the grid system is assembled or partially assembled, it can be raised to the ceiling height and suspended from fixed structural members. The series of main grid members 6 extending through at least some of the connection plates, adds to the structural integrity of the grid system. Also the connection plates 50 form an effective structural connection with the main and secondary grid members.

Figure 4:
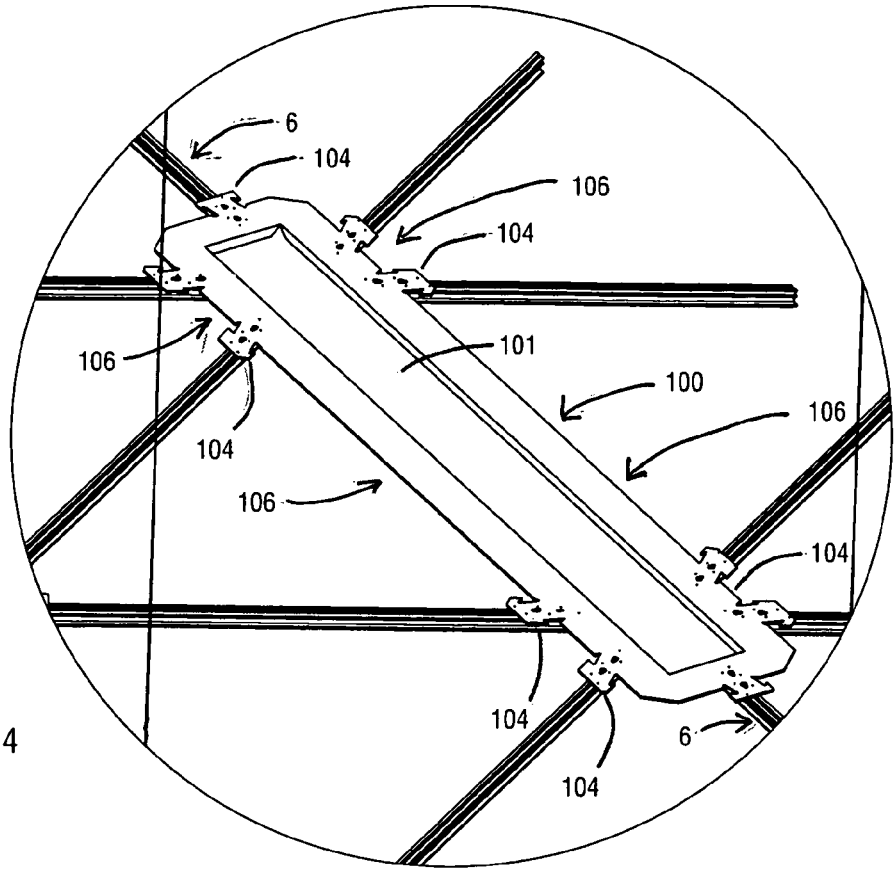
FIG. 4 is a top perspective view of a specialized frame for accommodating lighting fixtures in the ceiling grid network.

The partial perspective view of FIG. 4 includes details of a light connector 100 having an integral frame that forms part of the ceiling grid system and preferable forms part of a main axis with other main grid members 6. An electrical light fixture can be received into the center recess 101 and panels can be suspended at the longitudinal edges 106 of light connector 100. The light connector principle can also be used for other ceiling fixtures including diffuser grates for air ventilation systems and other applications.

FIGS. 2, 5, 6, 7, 8 and 9 show details of the grid members and the connection at an intermediate node using the connection plate 50. A six way connection plate 50 having six projecting arms 52 and each arm is at an angle relative to the adjacent arm of 60°. Each projecting arm 52 is designed to engage and appropriately align either a secondary grid member 8 or a main grid member 6 if the grid network allows for main grid members. Each projecting arm includes guide dimples 54 that collectively define a guide track 56 centered on each arm 52 with this guide track being adapted to engage the top flanges 71 of a main grid member 6 or a secondary grid member 8.

Figure 2:
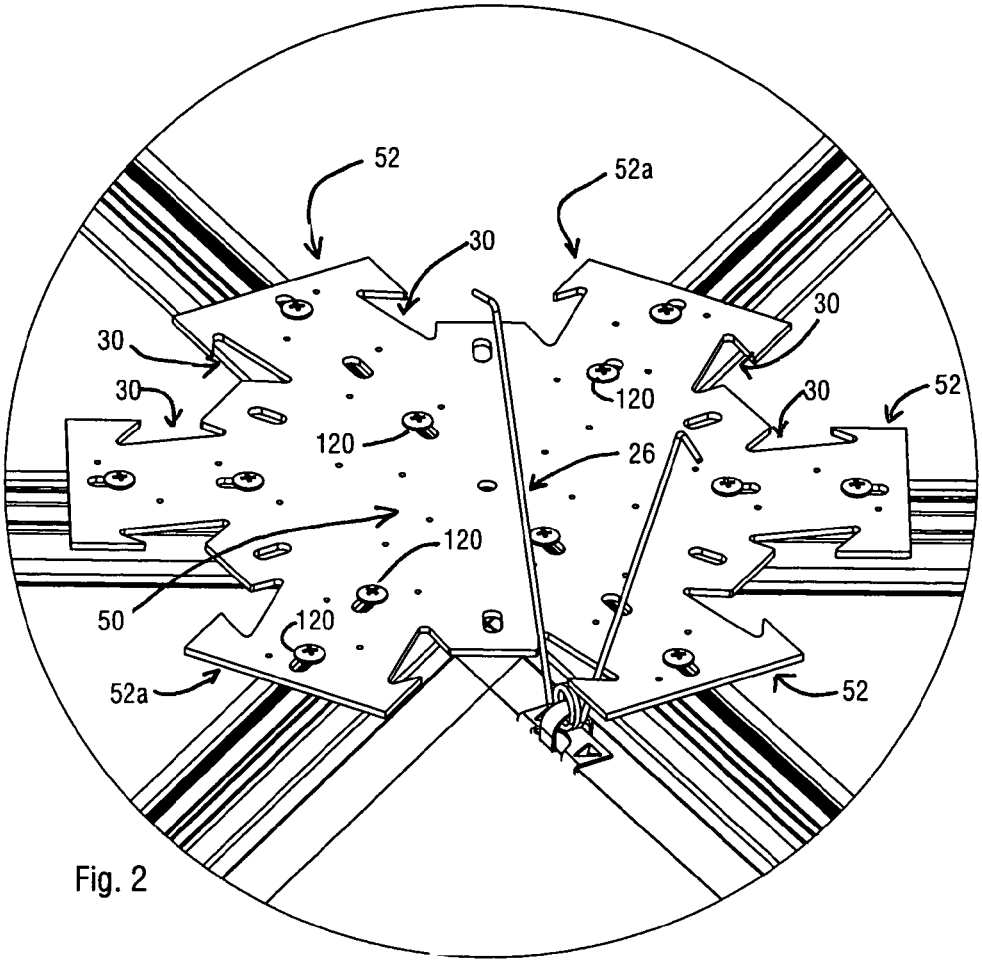
FIG. 2 is a partial perspective view showing an intermediate node of the grid network.
Figure 9:
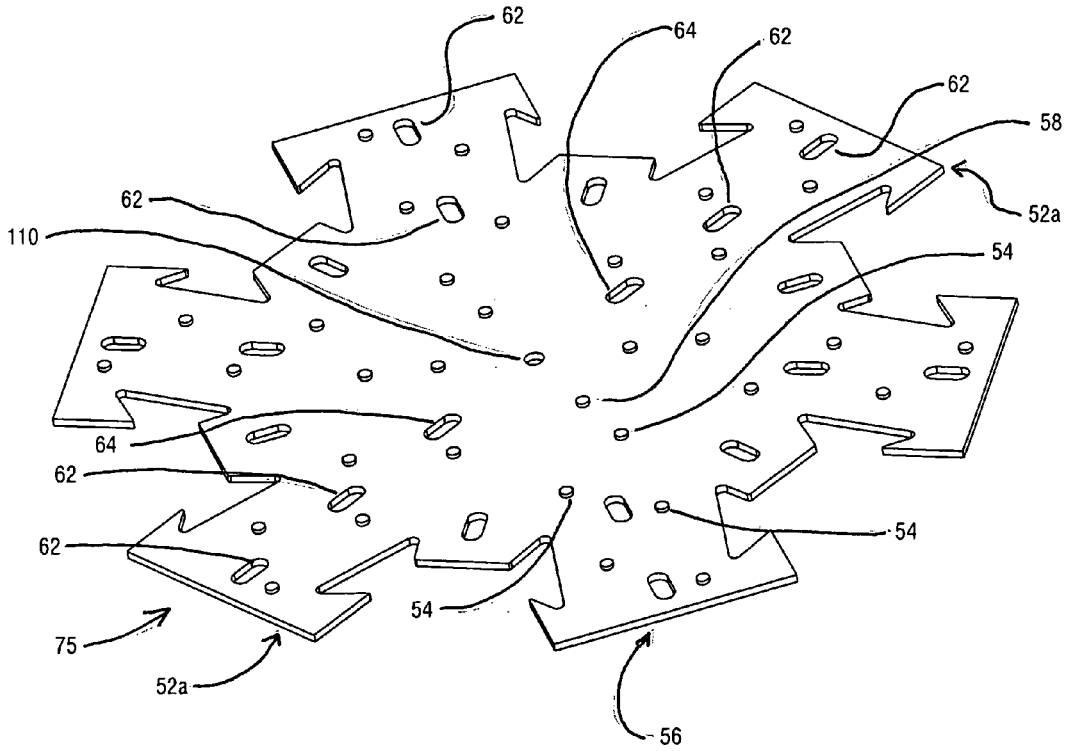
FIG. 9 is a partial perspective view showing details of the connection plate of the intermediate node.

In the preferred connection plate 50 as shown in FIGS. 2 and 9, two aligned projecting arms 52*a* cooperate to define a center guide track which passes through the connection plate 50 and is adapted to engage a main grid member 6. This guide track is generally shown as 75 in FIG. 9. This guide track not only includes securing slot 62 provided in each of the projecting arms 52*a*, but it also includes extended main securing slots 64. These main securing slots are interior to the projecting arms (i.e. the main securing slots are located closer to the center point 110 of the connection plate).

The connection plate 50 includes guide dimples 54, defining the guide tracks and also includes dimple stops 58. Each arm 52 includes guide dimples 54 (i.e. four guide dimples that engage the edges of the secondary grid members 8 to align the grid members relative to the projecting arm.) A dimple stop 58 is associated with each of the projecting arms for engaging a secondary grid member and provide a stop face spaced from the center of the connection plate. The guide track and stop face allow an installer to accurately secure the secondary grid members 8 to the connection plate and accurately define cells of the grid system.

The appropriate connection of the secondary grid members 8 and the main grid member 6 is shown in FIGS. 2, 5, 6, 7 and 8. Each of the projecting arms 52 or 52*a* also include torsion spring securing slots 30 and typically adjacent arms have opposed securing slots 30. These securing slots are spaced outwardly from the center of the connection plate 8 and are also placed outwardly from the ends of the secondary grid members 8. This simplifies securement of the torsion spring to the ceiling panels as the suspension points are positioned along the sides of the panels.

Figure 5:
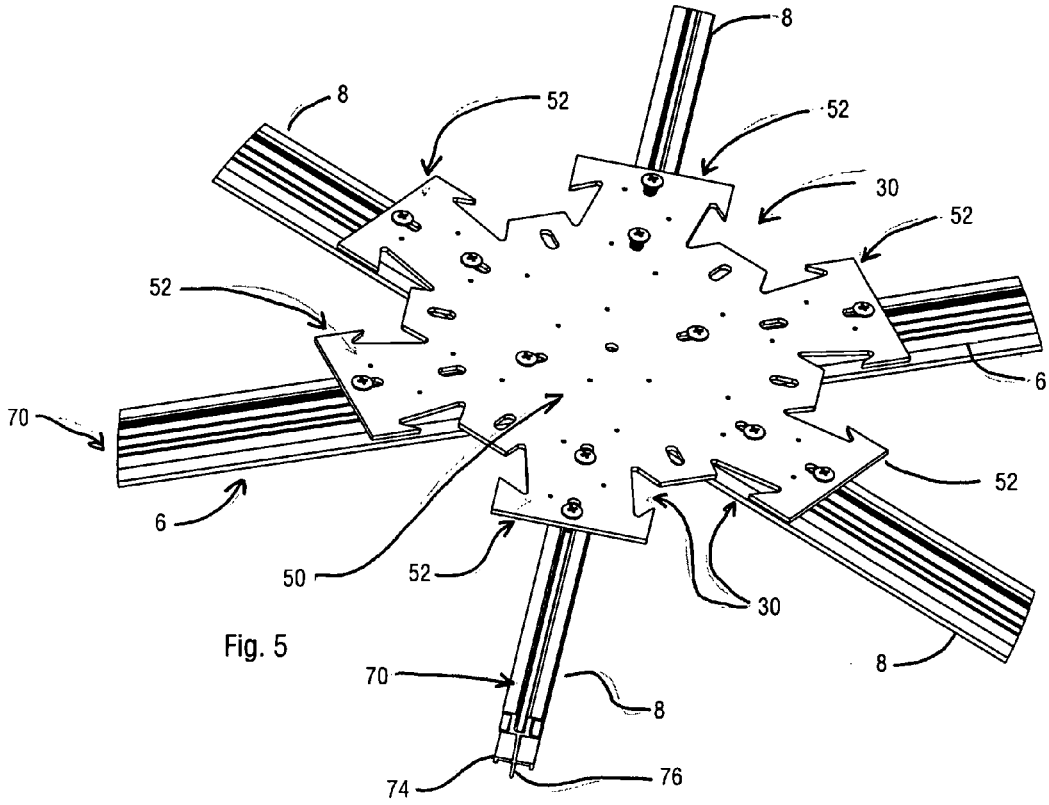
FIG. 5 is a partial perspective view showing a six-way intermediate node of the ceiling grid network.
Figure 6:
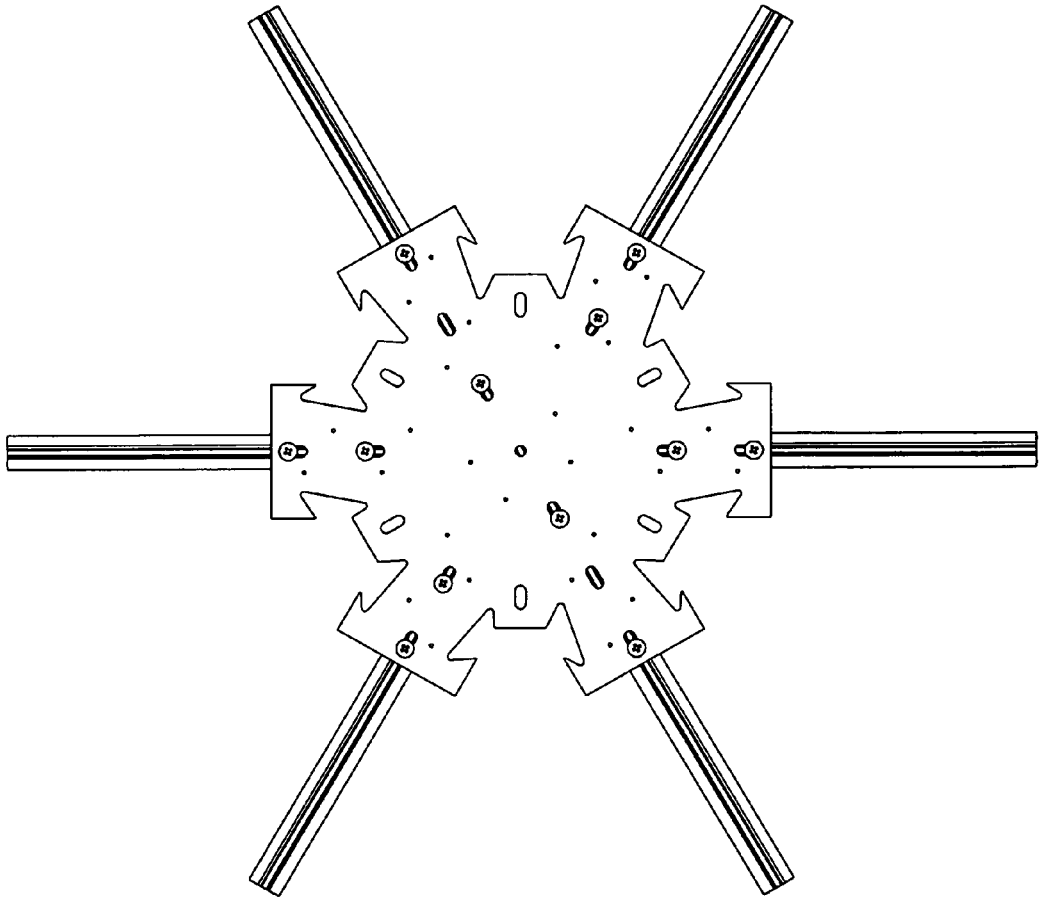
FIG. 6 is a top view of the intermediate node of FIG. 5.
Figure 8:
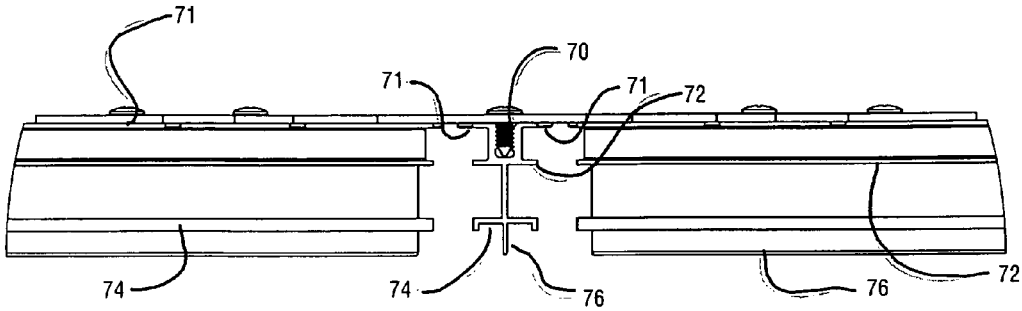
FIG. 8 is an end view of the intermediate node of FIG. 5.

FIGS. 2, 5 and 8 illustrate the cross section of the main grid members 6 and the secondary grid members 8. This cross section is a modified 'I' beam type structure with the securing slot 70 provided on an upper surface thereof for receiving screw fasteners 120 that pass through the connection plate 50. This slot 70 also includes outwardly extending flanges 71 for positively engaging the lower surface of the connection plate and the guide tracks. The grid members include intermediate cross flanges 72 and 74 and a projecting centered web 76. The grid members of this section are preferably manufactured as an extruded aluminum or aluminum alloy component and are easily cut to the appropriate length. This structure is easily cut at the time of manufacture and can also be cut on site at the time of installation. These members are pre-cut according to the grid system size and shipped to a job site unassembled. Once at the job site appropriate segments of the grid system, for example a portion of a corridor or a portion of a room, are assembled at table height and then raised upwardly once most of the assembly is complete. The grid system can then be secured beneath any structural securing members and connection of segments completed at ceiling height. Typically the connection plate includes a wire connector for securing to the structural components or it may include a threaded rod or other rod type connector. With this arrangement the system is easily adapted to meet local building codes.

The connection plate 50 is preferably punched or diecut and is inexpensive to manufacture. It is sized to overlap beyond the ends of the secondary grid members 8 to allow the torsion spring securing slots 30 to be significantly spaced from the center point of the connection plate.

The particular relationship of the secondary grid members and the main grid member can be appreciated from a review of FIG. 8. It can be seen that the secondary grid members are spaced from the center of the connection plate 50 as the secondary grid members have engaged the various dimple stops 58. The main grid member extends completely across the connection plate 50.

It has been found that the connection plate of the structure is easily manufactured and it can also be manufactured in relatively small run lots.

A more specialized connection assembly for the grid network is shown in FIGS. 4 and 11 through 14. In this case the light connector 100 is used and has an open center recess 101 for receiving a light fixture. The light connector 100 includes a projecting peripheral flange 102 and has a series of projecting arms 104 that extend outwardly from the peripheral flange. Each of these projecting arms include a guide track for receiving the connecting member and guide dimples and a dimple stop are associated with each of the projecting arms as described with respect to connector plate 50. The light connector 100 provides an accurate pattern for assembly of the grid members to accurately define the grid system.

The cooperating suspended ceiling panels abutting the light connector are of a particular size and preferably include a metal frame about the edges thereof. These frames cooperate with the downwardly projecting web of the grid members to accurately position the panels within the cell. The panel shapes are essentially standard with a truncated edge for abutant with the light connector. These modified panels are of a predetermined shape easily manufactured. This allows for convenient assembly on site and accurate connection.

As shown the light connector 100 forms part of the grid system and accurately connects with grid members using projecting arms 104. This determines the panel shapes that cooperate with the light connector 100. The light connector 100 as shown defines two intermediate nodes.

With the system as described and shown in the drawings, it is possible to provide factory produced components to the job site to meet the particular requirements. Once at the job site, these components are assembled and installed to form the ceiling grid system. This grid system reduces installation time, improves quality and requires less skill to install.

Figure 10:
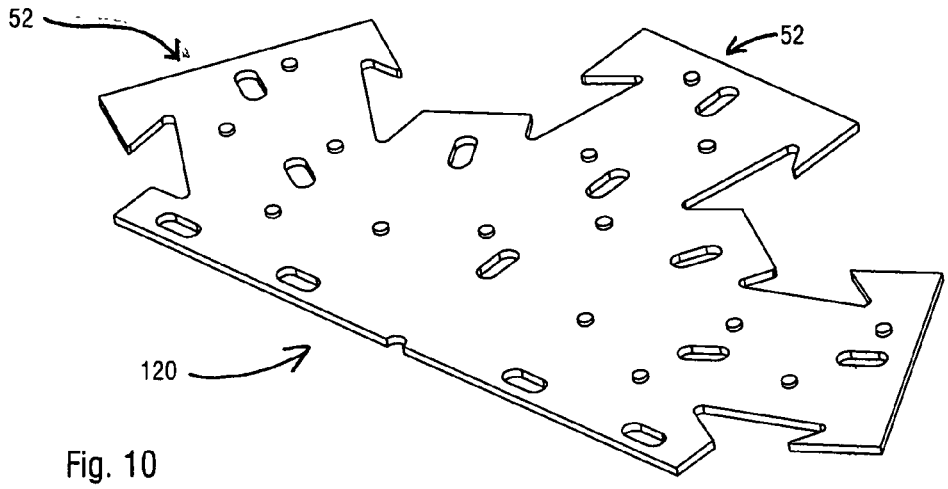
FIG. 10 is a bottom perspective view of a peripheral node.
Figure 11:
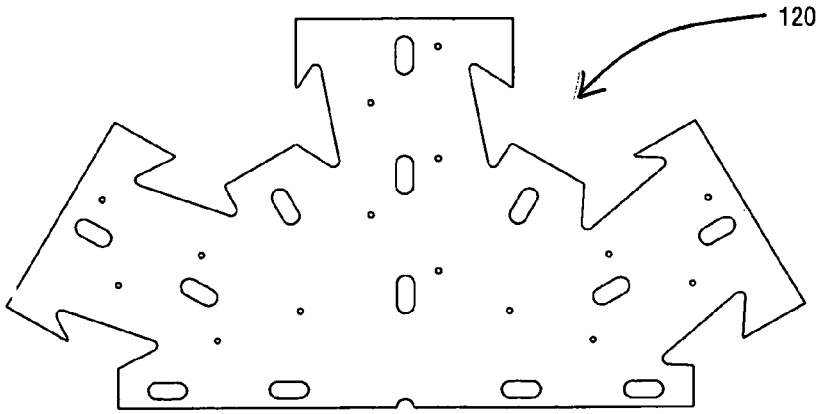
FIG. 11 is a top view of the peripheral node of FIG. 10.
Figures 12, 15:
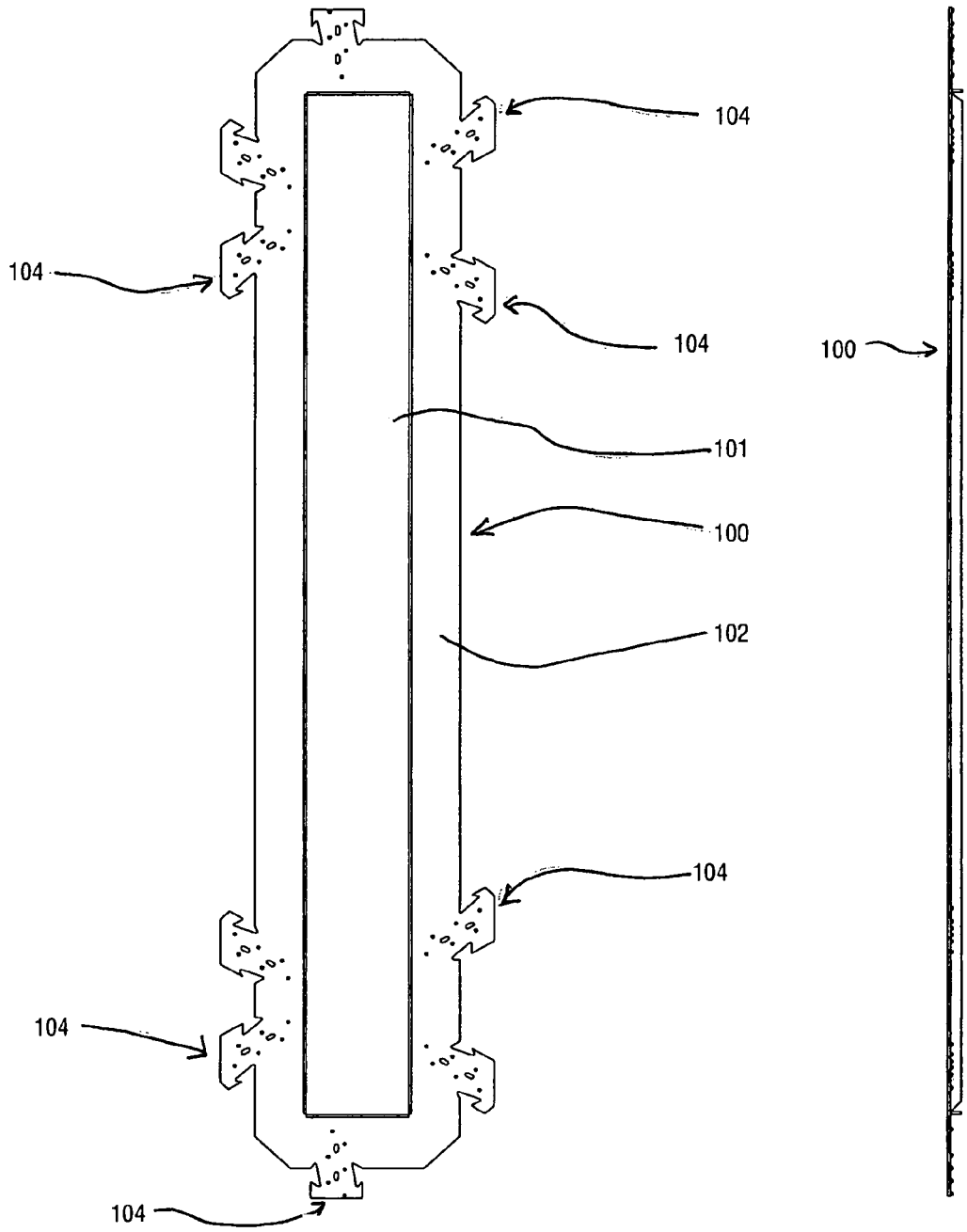
FIG. 12 is a top view of the light connector for a light fixture.
FIG. 15 is a side view of the light connector.
Figure 13:
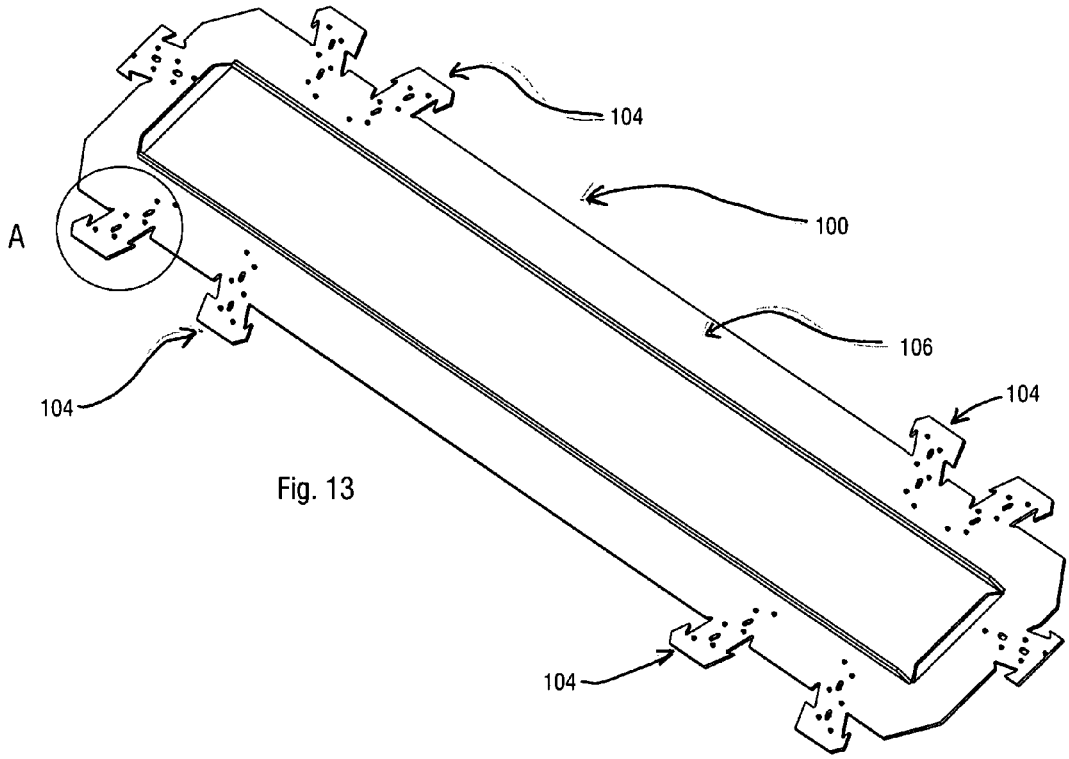
FIG. 13 is a partial bottom perspective view of the light connector.
Figure 14:
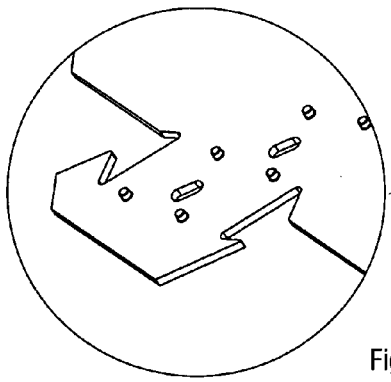
FIG. 14 is a partial perspective view of one of the projecting arms of the light connector.

FIGS. 10 and 11 show details of the connector plates 120 used to define edge nodes 12. Typically the edge nodes are half of the intermediate nodes as the periphery of the ceiling system is generally adjacent a wall. In some cases the edge nodes will be designed to allow connection at an inside special angle between abutting walls. These connection plates include projecting arms, guide tracks, dimple guides and dimple stops to simplify assembly and provide accuracy.

As can be appreciated, the suspended ceiling system is based on engineering drawings and the necessary components are manufactured and provided to the job site. Additional components may also be provided to address job site conditions that are only realized at time of installation. By providing some additional connection plates 50 these can be modified on site to meet the particular needs that may arise.

The system is cost effective to manufacture and cost effective to install.

The system has also been described with respect to a six way connector, however it is also possible to use an eight way connector for defining an octagonal-type grid network. An eight way connector can also be used to allow the suspension of a square panel which is typically defined between octagonal-type ceiling panels. Other grid networks and connection plates allow for custom ceiling solutions. Some of these grid systems will not allow main grid members and only secondary grid members will be used. Therefore, the present system is not limited to the six way system shown that is typically used with equilateral triangles. This system is readily adapted for defining different grid networks as may be required.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A suspended ceiling system comprising a grid system having a series of intermediate nodes interior to a peripheral edge of said grid system and a series of peripheral nodes at said peripheral edge of said grid system connected by grid members;

said series of intermediate nodes each including a connection plate with a series of guide tracks on a bottom surface thereof receiving and cooperating with an upper flange of said grid members to align said grid members in at least one predetermined geometric configuration;

each connection plate including separate fasteners mechanically securing said grid members to said connection plate aligned in said guide tracks;

each connection plate between adjacent guide tracks including a pair of generally opposed elongate connection slots with each elongate connection slot sized to receive a support spring of a suspended ceiling panel to secure the ceiling panel beneath said grid system and wherein said series of guide tracks include guide tracks with a downwardly projecting stop member and guide tracks without stop members; said stop members being spaced from a center point of said connection plate a sufficient distance to accommodate a grid member extending completely across said connection plate between two aligned projecting arms that include said guide tracks without stop members.

2. A suspended ceiling system as claimed in claim 1 wherein said at least one predetermined geometric configuration include at least five grid members spaced about a center point of each connection plate.

3. A suspended ceiling system as claimed in claim 1 wherein said predetermined geometric configuration includes at least six grid members and said ceiling panels are of a triangular shape.

4. A suspended ceiling system as claimed in claim 3 wherein said connection plate includes six projecting arms with each arm including one of said guide tracks; and wherein four of said guide tracks include said stop members and two of said guide tracks are without stop members.

5. A suspended ceiling system as claimed in claim 4 wherein said connection plate between adjacent projecting arms includes a notched out recess with the sides of said projecting arms in said notched out recesses defining said generally opposed elongate connection slots for receiving support springs of adjacent ceiling panels.

6. A suspended ceiling system as claimed in claim 5 wherein said ceiling panels are equilateral triangular ceiling panels sized to abut each other and conceal said grid system.

7. A suspended ceiling system as claimed in claim 1 wherein said connection plates are shaped to define a non rectilinear grid when said grid members are connected thereto.

8. A suspended ceiling system as claimed in claim 1 wherein said guide tracks are each defined by a series of downwardly extending dimples positioned to engage said upper flange of said grid members.

9. A suspended ceiling system as claimed in claim 8 wherein some of said series of guide tracks each include a downwardly extending stop member formed as a downwardly extending dimple of said connection plate in abutment with an end of said grid member aligned in the guide track.

10. A suspended ceiling system comprising a grid system having a series of intermediate nodes interior to a peripheral edge of said grid system and a series of peripheral nodes at said peripheral edge of said grid system connected by grid members;

said series of intermediate nodes each including a connection plate with a series of guide tracks on a bottom surface thereof receiving and cooperating with an upper flange of said grid members to align said grid members in at least one predetermined geometric configuration;

each connection plate including separate fasteners mechanically securing said grid members to said connection plate aligned in said guide tracks;

each connection plate between adjacent guide tracks including a pair of generally opposed elongate connection slots with each elongate connection slot sized to receive a support spring of a suspended ceiling panel to secure the ceiling panel beneath said grid system; and wherein the upper flange of each grid member includes a centrally disposed securing slot;

said centrally disposed securing slots receiving and retaining said separate fasteners to thereby secure said ceiling grid members to said connection plates.

11. A suspended ceiling system as claimed in claim 10 wherein each connection plate of an intermediate node includes at least six guide tracks and two of said guide tracks are aligned and form a common guide track across said connection plate.

12. A suspended ceiling system as claimed in claim 10 wherein said separate fasteners are screw fasteners that extend through ports in said connection plates.

13. A suspended ceiling system comprising a grid system having a series of intermediate nodes interior to a peripheral edge of said grid system and a series of peripheral nodes at said peripheral edge of said grid system connected by grid members;

said series of intermediate nodes each including a connection plate with a series of guide tracks on a bottom surface thereof receiving and cooperating with an upper flange of said grid members to align said grid members in at least one predetermined geometric configuration;

each connection plate including separate fasteners mechanically securing said grid members to said connection plate aligned in said guide tracks;

each connection plate between adjacent guide tracks including a pair of generally opposed elongate connection slots with each elongate connection slot sized to receive a support spring of a suspended ceiling panel to secure the ceiling panel beneath said grid system; and wherein said connection plate includes six projecting arms with each arm including a guide track; and wherein four of said guide tracks each include a downwardly projecting stop member and two guide tracks without stop members; said stop members of said four guide tracks being spaced from a center point of said connection plate a sufficient distance to accommodate a grid member extending completely across said connection plate between two aligned projecting arms that include said guide tracks without stop members.

14. A suspended ceiling system as claimed in claim 13 wherein said connection plate between adjacent projecting arms includes a notched out recess with the sides of said projecting arms in said notched out recesses defining said generally opposed elongate connection slots for receiving support springs of adjacent ceiling panels.

* * * * *